US006070294A

United States Patent [19]

Perkins et al.

[11] Patent Number: 6,070,294

[45] Date of Patent: Jun. 6, 2000

[54] HINGE FOR A SHOWER SCREEN DOOR

[75] Inventors: David Anthony Perkins, Brighton; Brian Ralph Perkins, Malvern; Robert Michael Mead, Somerville; Jon Graham Seddon, Surrey Hills, all of Australia

[73] Assignee: George Fethers & Co. Trading Pty LTD, Melboutne, Australia

[21] Appl. No.: 09/147,913

[22] PCT Filed: Sep. 10, 1997

[86] PCT No.: PCT/AU97/00586

§ 371 Date: Mar. 23, 1999

§ 102(e) Date: Mar. 23, 1999

[87] PCT Pub. No.: WO98/13568

PCT Pub. Date: Apr. 2, 1998

[30] Foreign Application Priority Data

| | | | |
|---|---|---|---|
| Sep. 23, 1996 | [AU] | Australia | PO2504 |
| Dec. 9, 1996 | [AU] | Australia | PO4071 |

[51] Int. Cl.[7] ..... E05D 5/02; E05D 11/10

[52] U.S. Cl. ..... 16/252; 16/286; 16/250; 16/334; 16/382

[58] Field of Search ..... 16/286, 280, 284, 16/252, 250, 251, 382, 387, 334, 335; 49/397, 399, 381; 160/199, 206, 210, 213

[56] References Cited

U.S. PATENT DOCUMENTS

| | | | |
|---|---|---|---|
| 1,640,525 | 8/1927 | Belliveau . | |
| 3,828,394 | 8/1974 | Horgan, Jr. | 16/250 |
| 4,545,090 | 10/1985 | Redmond | 16/385 |
| 5,079,798 | 1/1992 | Burke et al. | 16/252 |
| 5,297,313 | 3/1994 | Brin | 16/252 |
| 5,513,420 | 5/1996 | Kennedy | 16/252 |
| 5,613,276 | 3/1997 | Franz . | |
| 5,867,869 | 2/1999 | Garrett et al. | 16/252 |

FOREIGN PATENT DOCUMENTS

| | | | |
|---|---|---|---|
| 273333 | 9/1964 | Australia | 16/225 |
| 5860765 | 11/1966 | Australia . | |
| 5860965 | 11/1966 | Australia . | |
| 53 65786 | 8/1986 | Australia . | |
| 1271594 | 6/1968 | Germany . | |
| 2432158 | 1/1976 | Germany | 16/252 |
| 3538064 | 4/1987 | Germany . | |
| 3606276 | 9/1987 | Germany . | |
| 565308 | 8/1975 | Switzerland . | |

*Primary Examiner*—Chuck Y. Mah
*Attorney, Agent, or Firm*—James Ray & Associates

[57] ABSTRACT

A door hinge and a method of its use is provided which is suitable for use with glass shower screen doors. The method involves cutting a pair of circular cut-outs at a side edge of the door near the top and bottom of the door respectively. After toughening of the cut-out portions of glass, a hinge in accordance with this invention is mounted in each cut-out portion. The hinges each have a first arm which has a circular door mounting portion of substantially the same diameter as the cut-outs which are located in the cut-outs. The hinges each have two clamping parts, one part is fitted to abut with one face of the door, and the other part is fitted to abut with the other face of the door. Each part is fitted to immediately surround the respective cut-outs. The hinge then has screw holding means which holds the parts together and clamps the door. The second arm of the hinge can be mounted directly to a frame member, such as a jam member or to a further glass panel. In the case where mounting is to a further glass panel, the mounting can be by similar circular cut-outs, and by the second arm having a similar circular door mounting part, and clamping parts. By having circular cut-outs, it makes the cutting of the glass door less complicated than providing square shaped cut-outs used in the past.

17 Claims, 5 Drawing Sheets

HINGE FOR A SHOWER SCREEN DOOR

FIELD OF THE INVENTION

This invention relates to hinging and relates particularly but not exclusively to the hinging of glass shower screen doors or like panel doors.

DESCRIPTION OF PRIOR ART

Hitherto, it has been known to provide glass shower screen doors. These have been known in the trade as being of one of the following types: framed, semi-framed, and frameless. In a framed shower screen door, the door is of glass but it is completely framed around its perimeter with a metal frame such as aluminium. Hinges can be fastened directly to the aluminium frame to, in turn, hinge the door relative to a jamb or a return panel of a shower screen installation. The hinging in such frame shower screen installations is generally satisfactory, however, the appearance of the frame around the perimeter of the door tends to be rather aesthetically unpleasing. A semi-framed shower screen door is one which comprises a glass screen door with a top and bottom frame. The hinges are attached to the top and bottom frames. Typically in such arrangements, the hinges comprise pins which extend from the top and bottom frames and pass respectively into a head section and/or a sill section of the shower screen installation. These installations appear aesthetically more pleasing than the fully framed shower screen installations but are still not as aesthetically pleasing as a frameless shower screen installation. In a frameless shower screen installation, there is no frame about the glass screen door. Rectangular cut-outs are checked into one side edge of the screen door and an expensive metal hinge is then fitted within the rectangular shaped cutouts. Typically, such shower screen doors are manufactured from 8, 10 or 12 mm thick glass to provide the necessary rigidity and strength. This, in turn, means that the weight of the screen door is excessive, and the hinge design must take this into account. Because of the rectangular nature of the cut-outs which are time consuming to cut, and the nature of the metal hinges themselves, frameless shower screen doors have been expensive and have had limited appeal even though aesthetically they are superior to the framed and semi-framed types.

OBJECTS AND STATEMENTS OF THE INVENTION

The present invention has been devised to attempt to overcome one or more of the aforementioned problems.

Therefore in accordance with a first broad aspect of the present invention there may be provided a method of hinging a glass shower screen door or like panel door comprising 1. Providing said door,
2. Cutting a first circular cut-out through said door at a side edge of said door so said first cut-out extends transversely of the plane of said door, said first cut-out being inwardly of the top of said door,
3. Cutting a second circular cut-out through said door at said side edge of said door so said second cut-out extends transversely of the plane of said door, said second cut-out being inwardly of the bottom of said door,
4. Toughening the glass of said door after said first and said second cut-outs have been cut,
5. Mounting a first hinge to said door at said first cut-out and a second hinge to said door at said second cut-out, said first hinge and said second hinge each having a circular door mounting part of substantially the same diameter as the diameter of the respective circular cut-outs, said circular door mounting part being adapted to fit within a respective one of the cut-outs, each said first and second hinges having two door face clamping parts, one clamping part being for abutting with one face of said door immediately surrounding a respective cut-out, the second clamping part being for abutting with the opposite face of the door immediately surrounding the respective cut-out, and holding means holding both hinges to said door at said respective cut-outs.

Most preferably a respective cover plate is then fitted over the one clamping part and the second clamping part.

It is particularly preferred that said method provide each cut-out of substantially half circular shape by a circular cutter which is positioned to overlap said side edge during cutting.

It is also particularly preferred that said glass door have a thickness of between 5.5 mm and 13 mm and that the positioning inwardly of said cut-outs relative to the top and bottom of the door be at positions to average for minimum flexing of said door caused by forces applied to said door to open said door from the remote side edge of said door.

A shower screen installation having a glass shower screen hinged therein according to the above method is also provided.

According to a further aspect of the present invention there is provided a hinge for a door, said hinge having a first arm for fitting to said door and a second arm for fitting to a structural support surface for said door, there being hinge pin means interconnecting said first arm and said second arm to permit relative hinging movement of said first arm and said second arm, said first arm having a circular door mounting part for passing into the thickness of said door in a corresponding circular cut-out provided though said door at a side edge of said door, said first arm also having a door first face clamping part for abutting with one face of said door immediately surrounding said cut-out into which said door mounting part is passed, said door first face clamping part being connected integrally with said circular door mounting part, said first arm also having a door second face clamping part for abutting with the opposite face of said door immediately surrounding said cut-out into which said door mounting part is passed, Said first arm having screw means for engaging with both clamping parts to draw both clamping parts together, to clamp the hinge to said door at said cut-out.

It is particularly preferred that there be a respective cover plate for fitting over each door face clamping part.

It is particularly preferred that said circular door mounting part be half circular in shape and that said cut-out in said door also be half circular in shape.

It is also particularly preferred that the central longitudinal axis of said hinge pin be positioned within said circular door mounting part so that when said hinge is mounted to said door the hinge axis will be inwardly of said edge of said door.

It is also particularly preferred that said first arm be of a plastics material such as a glass filled plastics material.

It is also particularly preferred that said door first face clamping part and said door second face clamping part be of ribbed construction to provide resistance to bending or warping thereof.

In one embodiment said hinge is for suspending said door from a jamb member or surface and in this case said second arm comprises a jamb mount bracket.

In another embodiment said hinge is for suspending said door from a glass panel and in this case said second arm has a circular door mounting part for passing into the thickness of said glass panel in a corresponding circular cut-out provided through said panel at a side edge of said panel, said second arm also having a glass panel first face clamping part for abutting with one face of said glass panel immediately surrounding said cut-out through said panel, and said second arm also have a door second face clamping part for abutting with the opposite face of glass panel immediately surrounding said cut-out into which said circular door mounting part is past, said second arm having screw means for engaging with both clamping parts to draw both clamping parts together, to clamp the hinge to said glass panel at said cut-out.

It is also preferred that said hinge have biasing means for biasing said hinge to return to a predetermined angular position after said hinge has been operated.

According to a further aspect of the present invention there is provided a hinge for a door, said hinge having a first arm for fitting to said door and a second arm for fitting to a structural support surface for said door, there being hinge pin means interconnecting said first arm and said second arm to permit relative hinging movement of said first arm and said second arm, said first arm having a door mounting part for passing into the thickness of said door in a corresponding cut-out provided though said door at a side edge of said door, said first arm also having a door first face clamping part for abutting with one face of said door immediately surrounding said cut-out into which said door mounting part is passed, said door first face clamping part being connected integrally with said door mounting part, said first arm also having a door second face clamping part for abutting with the opposite face of said door immediately surrounding said cut-out into which said door mounting part is passed, said first arm having holding means for holding both hinges to said door at said cut-out.

It is particularly preferred that there be a respective cover plate for fitting over each door face clamping part.

It is also particularly preferred that the central longitudinal axis of said hinge pin means be positioned within said door mounting part so that when said hinge is mounted to said door the hinge axis will be inwardly of said edge of said door.

It is also particularly preferred that said first arm be of a plastics material such as a glass filled plastics material.

It is also particularly preferred that said door first face clamping part and said door second face clamping part be of ribbed construction to provide resistance to bending or warping thereof.

It is also particularly preferred that said hinge have a biasing means to return the hinge to a predetermined angular position after said hinge has been operated.

It is further particularly preferred that said biasing means comprise said hinge pin means having a machined face which will co-operate with a detent means also with a co-operating machined face, and biasing means urging said detent means into engagement with said hinge pin means whereby when both faces are angularly displaced relative to one another said biasing means will act to displace them into mating face-to-face relationship, thereby returning the hinge to said predetermined angular position.

It is further particularly preferred that said second arm have a first part and a second part and wherein said first part receives said hinge pin means, said first part being swingably connected with said second part, and wherein said second part is for structurally supporting said door from said support surface, said first part and said second part being holdable in a desired angular swing orientation to each other by holding means, whereby to align said door in said predetermined angular position set by the held swung orientation of said first part and said second part.

BRIEF DESCRIPTION OF THE DRAWINGS

In order that the invention can be more clearly ascertained examples of preferred embodiments will now be described with reference to the accompanying drawings wherein.

DETAILED DESCRIPTION OF PREFERRED EMBODIMENTS

Figure 1:
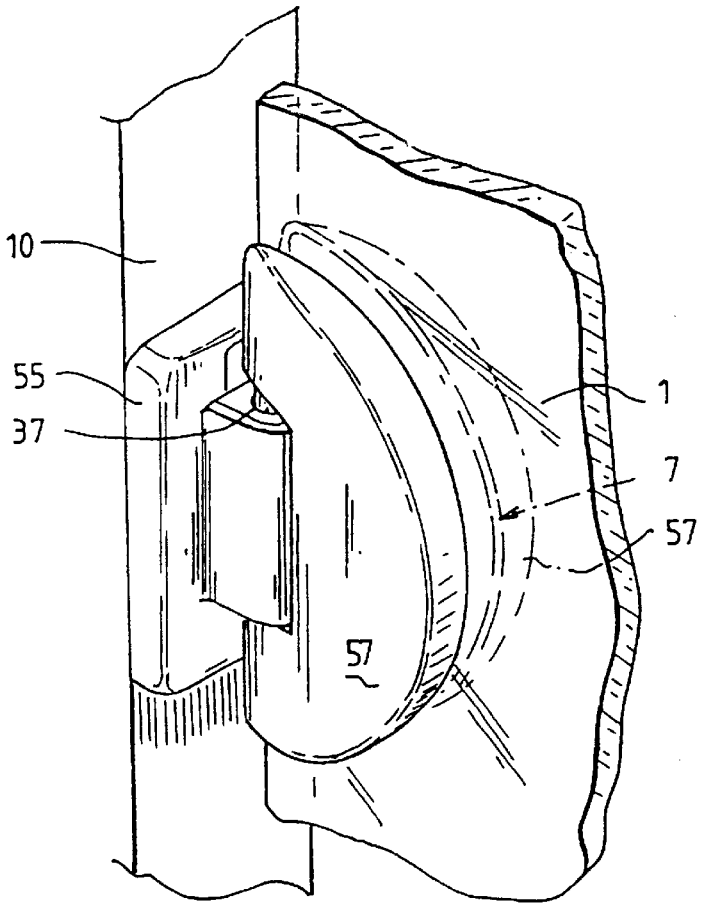
FIG. 1 is a perspective view of a first example which is used for mounting a glass shower screen door of like door to a structural support surface for said door such as a jamb member.
Figure 3:
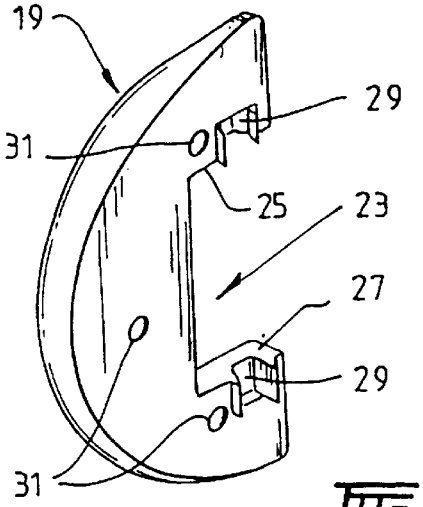
FIG. 3 is a perspective view of an inside face of a first arm of the hinge showing a door first face clamping part.
Figure 4:
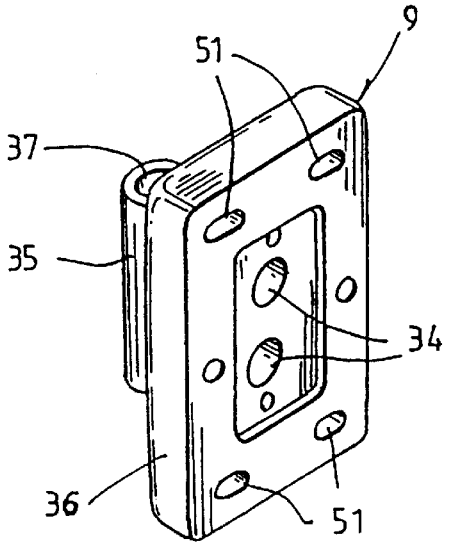
FIG. 4 is a rear perspective view of a second arm of the hinge.
Figure 2:
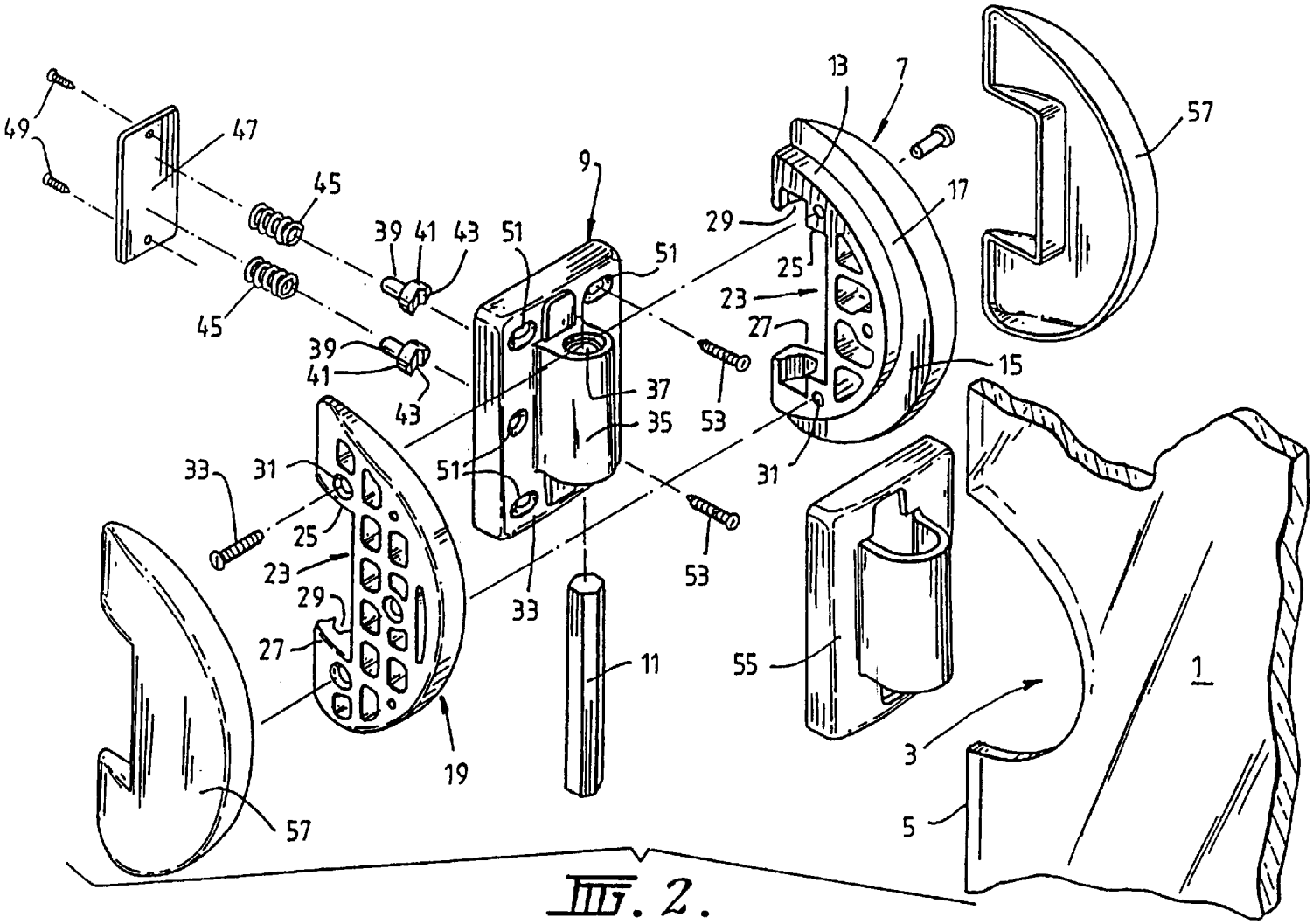
FIG. 2 is an exploded perspective view of the various parts of the example in FIG. 1.
Figure 5:
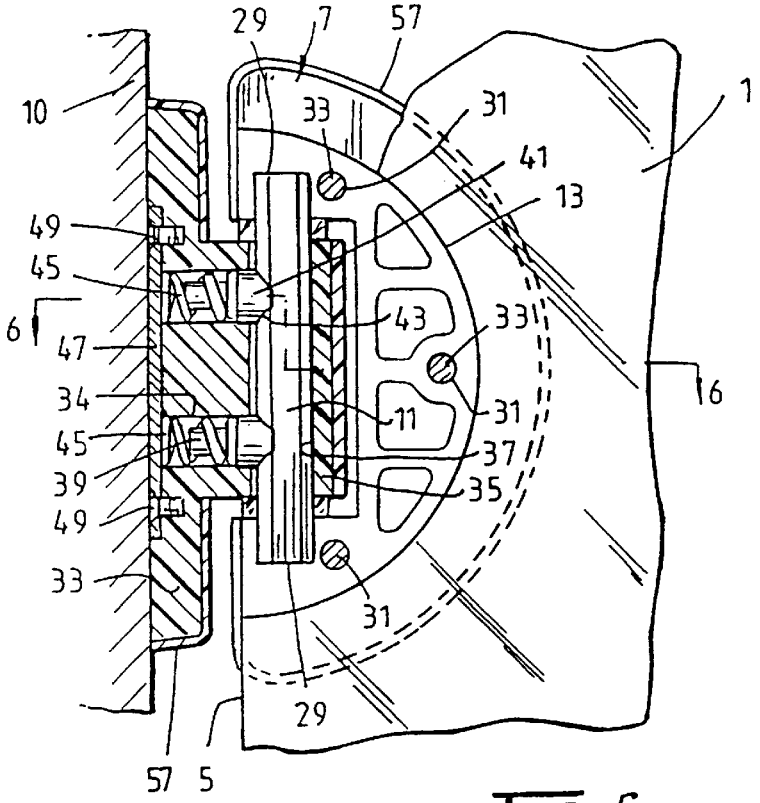
FIG. 5 is a cross sectional front elevational view taken centrally of the plane of the glass shower screen door.
Figure 6:
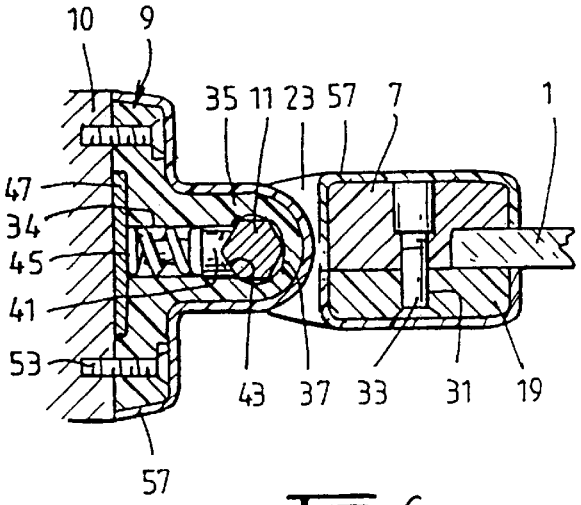
FIG. 6 is a cross sectional view along section line 6—6 of FIG. 5.
Figure 7:
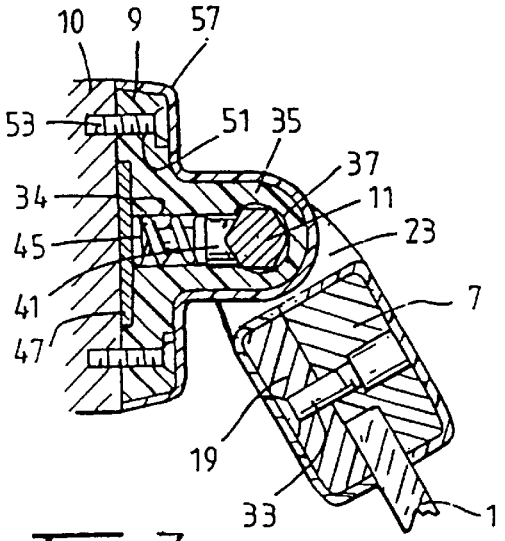
FIG. 7 is a cross sectional view similar to that of FIG. 6 but showing the glass shower screen door swung partly open.

Referring now to FIGS. 1 through 7 which show an example which is used for connection of a glass screen door 1 to a structural support surface for said door, such as a jamb member 10, it can be seen that the door 1 is provided with a circular cut-out 3 for the hinge. The circular cut-out 3 is, in fact, a half circle and is cut into the glass panel door 1 by means of a circular cutter which passes transversely of the plane of the door 1. The cut-out 3 is provided at a position close to the top of the door 1 and is therefore inwardly of the top of the door. A similar cut-out 3 is provided near the bottom of the door and is therefore inwardly of the bottom of the door. Both of the cut-outs are at the side edge 5 of the door. After the cut-outs have been provided in the door 1, the glass from which the door 1 is made can be toughened as is required to provide structural strength and statutory safety requirements for the glass shower screen panel door 1. Typically, the cut-outs 3 are provided in the glass panel door 1 at positions which will be to average for minimum flexing of the door caused by forces applied to the door to open the door from the remote side edge of the door. In other words, the positions of the cut-outs 3 are suitably chosen so that they are not near the centre of the door and not near the top of the door. Thus, irrespective of where the remote edge of the door is pushed to, in turn, open and close the door, it will result in minimum flexing of the door 1 itself.

It is particularly preferred that the thickness of the glass panel door 1 be 6 mm glass however glass having a thickness of between 5.5 and 13 mm or other thickness is not to be excluded. It should be anticipated that with glass of 6 mm thickness it will have substantially less weight than glass of the usual thickness for frameless shower screen doors 1 such as 10 mm.

The hinge has a first arm 7 which is attached to the panel door 1 and a second arm 9 which is attached to the structural support surface for the door which, may be a wall or a jamb member 10. The first arm 7 and the second arm 9 are hinged together by a hexagonal hinge pin 11. The central longitudinal axis of the hinge pin 11 is positioned within the first arm 7 and also within a circular door mounting part 13 which fits in the cut-out 3. In other words, the position of the central longitudinal axis of the hinge pin 11 is inwardly of the edge 5 of the door panel 1.

The circular door mounting part 13 is substantially identical in diameter to the diameter of the cut-out 13 and is also half circular. The thickness of the circular door mounting part 13 is preferably equal to the thickness of the thinnest door panel 1 which is to be mounted. Desirably however, the thickness is 6 mm. In this way, when the circular door mounting part 13 is received within the cut-out 3, it will equal the thickness of the door panel 1 or be just marginally smaller.

The first arm 7 includes a door first face clamping part 15 which has a face 17 which is used for abutting with one face of the door panel 1 around the cutout 3. In this embodiment the door first face clamping part 15 is integrally moulded with the circular door mounting part 13, however, it should be understood that it may be a separate part which is integrally connected with the circular door mounting part 13.

The first arm 7 includes a door second face clamping part 9 which has a face 21 (see FIGS. 2, 3 and 5) for clamping with the opposite face of the door panel 1 to that clamped by the face 17 of the first arm 7. When the door first face clamping part 15 is placed on one side of the glass panel door 1 and the door second face clamping part 19 on the other face of the glass panel door 1, centrally located relative to the cut-out 3, the hinge pin 11 can be retained captive and unable to rotate between the parts 15 and 19. The hinge pin then spans a cut-out 23 between an upper arm 25 and a lower arm 27. It should be noted from the figures that check-outs 29 in which the hinge pin 11 locates in the arms 25 and 27 are not symmetrical in both parts 15 and 19. This is because in the first arm 7 there is a check-out 29 in the circular door mounting part 13, and a further check-out 29 in the door second face clamping part 19. The hinge pin 11 is to be held in the check-outs 29 so that the central longitudinal axis of the hinge pin 11 is centrally of the thickness of the glass and hence the off-set of the checkouts 29.

Each of the parts 15 and 19 has screw openings 31 which will enable holding means in the preferred form of screw means 33 to pass therethrough to clamp the fist arm 7 of the hinge to the glass panel door 1 by frictional and clamping forces acting on the faces 17 and 21, and on the respective faces of the glass panel door 1 immediately around the cut-outs 3.

The second arm 9 is provided as a wall or a jamb mounting bracket and comprises a rectangular plate 36 which has an upstanding central arm 35 which, in turn, has a central bore 37 therethrough. The hinge pin 11 passes through the central bore 37 and is arranged to be a tolerance fit to permit rotation within the bore 37 without being unduly loose. The height of the arm 35 spans the height of the cut-out 23 in the first arm 7. Thus, when the first arm 7 and the second arm 9 are fitted together there is close engagement but there is sufficient tolerance to allow for relatively free swinging movement about the pivot pin 11.

The rear of the plate 36 is provided with two apertures 34 in which the heads of detent pins 39 can be received. These apertures extend through to the bore 37. It can be seen that the heads 41 of the detent pins 39 are machined with part hexagonal faces 43 which, in turn, match with the hexagonal shape of the hinge pin 11. Spring means 45 are placed over the shanks of the detent pins 39 and the detent pins and springs are retained relative to the plate 36 by a retaining plate 47 held thereto by means of screws 49. Thus, the spring means 45 urges the detent pins 39 into engagement with the hexagonal faces of the hinge pin 11. When the panel door 1 swings about the hinge axis, the hinge pin 11 is caused to rotate because it is firmly held within the check-outs 29 in the first arm 7, and the hinge pin 11, in turn, rotates within the bore 37. Thus, the detent pins are forced away from the hexagonal faces of the hinge pin 11 against the spring means 45. The detent pins 39 continue to apply pressure to the hinge pin 11 and this, in turn, provides for a self closing feature for the door to return it to a predetermined angular position which typically is at right angles to the plane of the plate 36 where the door is closed.

The plate 36 is provided with apertures 51 through which screws 53 can pass to, in turn, attach the second arm 9 to the structural support surface for the door. A cover plate 55 is provided to fit over the second arm 9 to, in turn, conceal the screws 53. The cover plate 55 can be snap lock engageable with the plate 36. The first arm 7 has cover plates 57 which, in turn, fit over the door second face clamping part 19 and the door first face clamping part 15 to, in turn, hide the screws 33. The cover plates 57 can be snap lock engageable with the parts 15 and 19.

The hinge is assembled firstly by attaching the first arm 9 relative to the structural support surface and. then applying the cover plate 55. The hinge pin 11 can be inserted through the bore 37. The door first face clamping part 15 can then be fitted so that the circular door mounting part 13 is within the cut-out 3 of the door panel 1. The door second face clamping part 19 can then be moved into required alignment and the hinge pin 11 located in the appropriate check-outs 29. The screws means 33 can then be used to clamp the door first face clamping part 15 and the door second face clamping part 19 to the panel door 1. The cover plates 57 can then be fitted over the parts 15 and 19. Both hinges of a door can be fitted in the same way.

The first arm 7 and the second arm 9 can be made of an industrial strength quality plastics material such as glass reinforced nylon and can therefore be moulded economically by known moulding techniques. This contrasts significantly from hinges used in the past for frameless shower screen doors which have been located in square or rectangular shape cut-outs in the glass. In those cases various faces of the hinges need specialised machining.

In order to provide sufficient rigidity to the hinge parts 15 and 19, to prevent against bending or warping thereof, the door first face clamping part 15 and the door second face clamping part 19 may be ribbed as shown. The ribs have been shown blind. In other words, the apertures which define the ribs do not extend completely through to the faces of the parts 15 and 19 which abut with the respective faces of the door 1. This, in turn, provides for a continuous smooth surface on those faces which will assist clamping to the glass door panel 1. The ribbing has been provided not for economy in use of plastics material but solely to provide for rigidity to the parts 15 and 19 as enormous forces are required to clamp the relevant faces of the glass door panel 1 having regard to the suspended weight of the door 1.

A gasket may be provided on the faces of the parts 15 and 19 which abut with the respective faces of the glass panel door 1 to assist in good mating relationship and the subsequent clamping. In some cases this may be an adhesive material.

It should also be seen that the circular door mounting part 13 is ribbed as well. This is to provide for sufficient rigidity and strength to the door mounting part 13 for the same reasons as the parts 15 and 19.

The covers 55 and 57 may be made from plastics material or alternatively from sheet metal or any other suitable material.

It should be appreciated that the nature of the design is such that the faces of the door first face clamping part 15 and door second face clamping part 19 may not necessarily be half circular as shown but may be rectangular or of other outline to provide for an aesthetic appearance to suit particular trends in the building industry. Similar, the covers 57 may be of desired shapes to provide for aesthetic building trends at any given time. The essential requirement however is that the cut-out 3 is circular and so too is the circular door mounting part 13 which nests closely within the cut-out 3.

In the embodiment shown, the circular door mounting part 13 is shown wholly on and integral with the door first face clamping part 15 and is not split so that half the thickness of the door mounting part 13 is on the clamping part 15 and the other half thickness is on the door second face clamping part 19. This has been provided to provide unitary structure to the circular door mounting part 13 to provide for as much possible strength to that part. If it were manufactured in two identical halves that were brought together, then it would not have the same strength as if it were made as a single piece.

Figure 8:
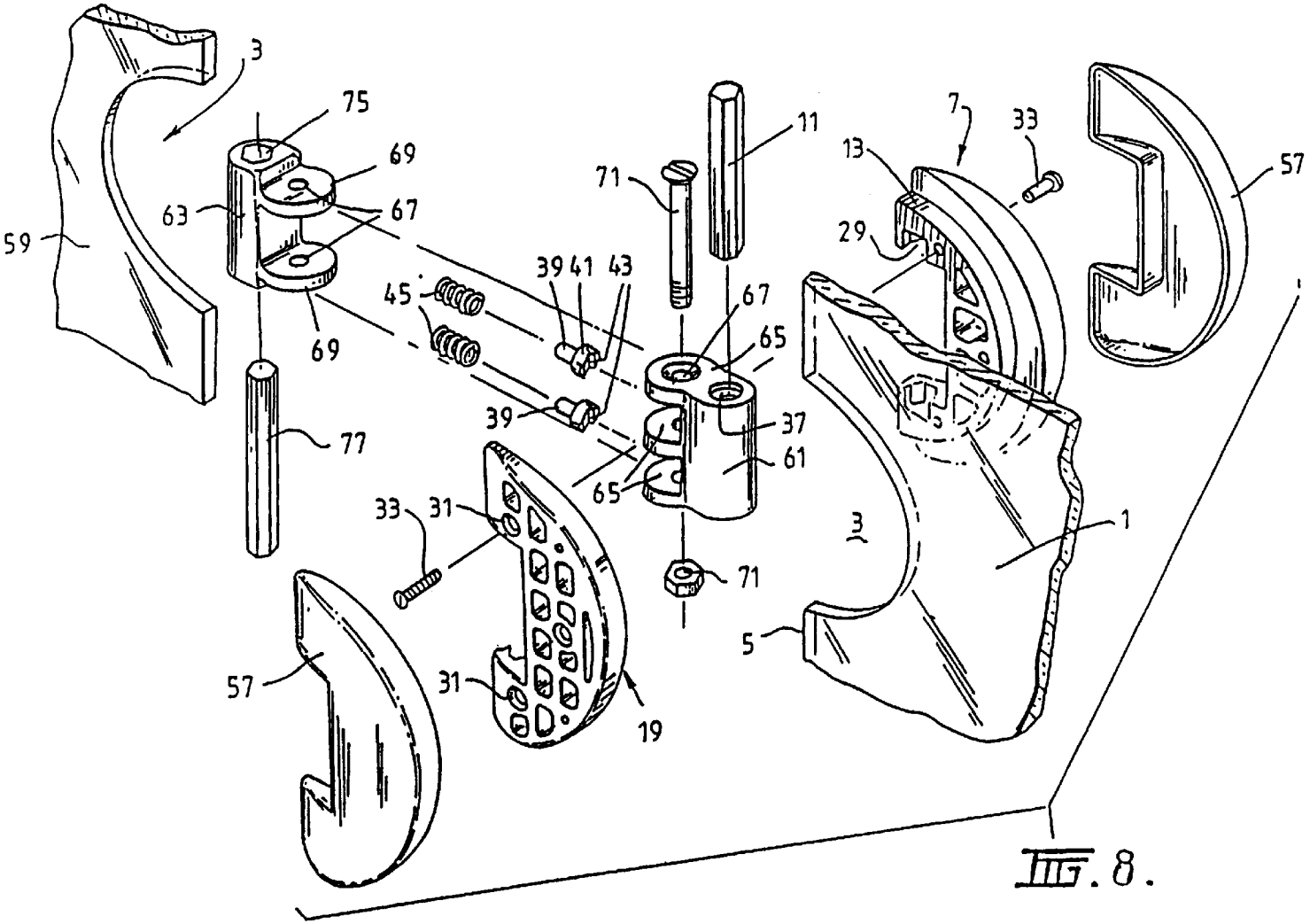
FIG. 8 is an exploded perspective view showing the majority of the parts used in a further example of the invention where a glass door is supported by a fixed panel such as a further glass panel.
Figure 9:
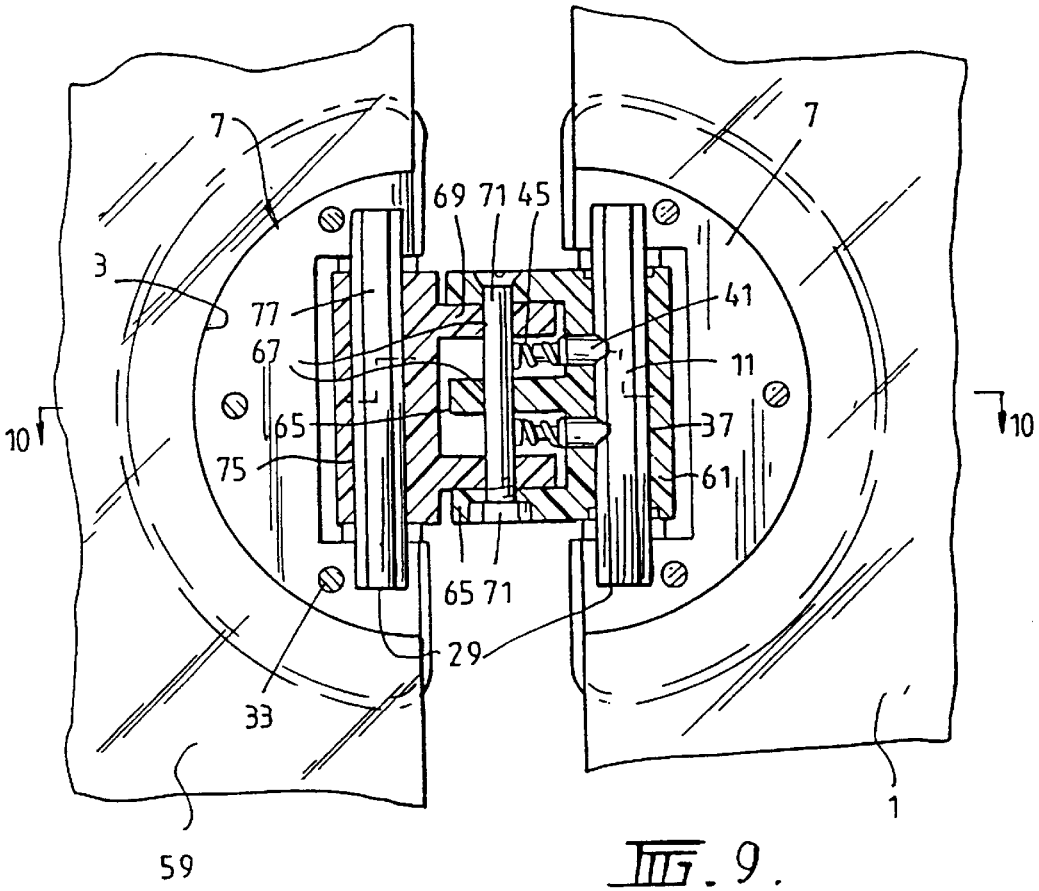
FIG. 9 is a cross sectional front elevational view of a hinge of the example of FIG. 8 taken centrally of the plane of the glass shower screen door.
Figure 10:
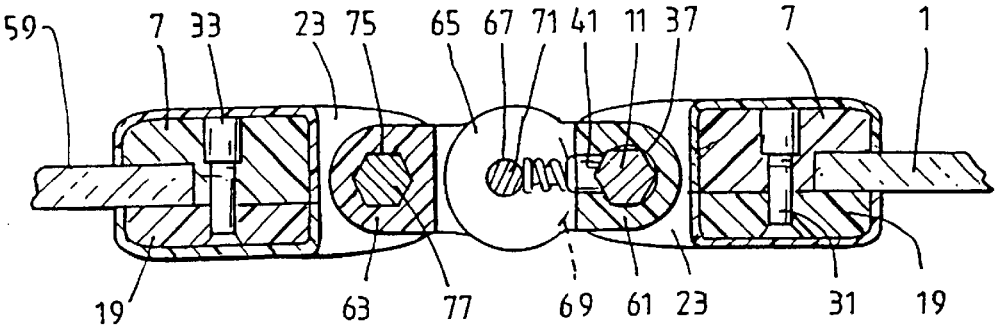
FIG. 10 is a cross sectional view taken along section line 10—10 of FIG. 9.

Referring now to the embodiment of FIGS. 8 through 10 which relate to an example for connection with a structural support surface which can comprise a further panel such as a fixed frameless glass panel, it can be seen that the circular door mounting part 13 and the door first face clamping part 15 and the door second face clamping part 19 are of the same construction as in the earlier described example. Similarly, the cover plates 57 are the same as in the earlier described example. Hence, they have been provided with the same numerical designations. It is also seen that the hinge pin 11 is of the same construction. In this example the fixed panel is shown by numeral 59 and comprises similar cut-outs 3 to those on panel 1.

Typically, the circular cut-outs 3 can be produced by bringing both panels 1 and 59 together and cutting both cut-outs 3 at the aligned position for the upper cut-outs 3. The lower cut-outs 3 can be produced in a similar manner with the one cutting tool at the same time. After all the cut-outs 3 have been made, the panels 1 and 59 can be then toughened in a known manner.

In this embodiment the second arm of the hinge comprises a first part 61 and a second part 63. The part 61 has a bore 37 in which the hinge pin 11 is received. The part 61 has a vertical height as shown in FIG. 9 to fit within the spacing between the arms 25 and 27 of the first arm as described in the earlier embodiment. Part 61 has three fingers 65 which extend therefrom. These fingers 65 have a central bore 67 therethrough. The second part 63 has two fingers 69 extending therefrom and the spacing apart is such that they can fit between the fingers 65 on the first part 61. All fingers 69 have a central bore 67 therethrough.

The first part 61 can be held to the second part 63 by the interfitting of fingers 65 with fingers 69 and by a bolt and nut 71 passing through the bore 67 thus retaining parts 61 and 63 interengaged. Prior to the bolt and nut 71 being fastened, spring means 45 and detent means 39 are passed though detent openings 73 in the first part 61. Particular reference should be made to FIGS. 27 and 29 where these openings are clearly shown. The springs 45 and the detent pins 39 are therefore held captive behind the bolt and nut 71.

The part 63 has a central bore 75 of hexagonal shape in which a pin 77 is received. The pin 77 is, in fact, an identical pin to the hinge pin 11 but because the bore 75 is hexagonal, there is no relative rotation of the pin 77 relative to the second part 63.

The part 63 with the pin 77 is then held to the panel 59 by similar circular door mounting part 13, door first face clamping part 15, and door second face clamping part 19 to that which is used on the door panel 1.

Thus, it can be seen that the part 63 is rigidly held to the panel 59 and that part 63 interconnects with part 61. The bolt and nut 71 can be tightened to rigidly clamp part 63 relative to part 61. If desired these parts may be angled relative to one another to compensate for angled panel 59 relative to door panel 1 which may be at angles other than 180° to each other. In that event, when the desired angular orientation is achieved the bolt & nuts 71 can be tightened to secure these parts together in the angled orientation. A wide range of angles can be achieved ith this arrangement. If desired grooves and ribs may be provided on the fingers 65 and 69 at set angular positions such as 180°, 90°, 120° etc. so that there can be location at pre specified angles. In this situation the ribs would locate with the appropriate grooves and provide a stop at those angular positions because the two parts are then not tightly screwed together by the bolt and nut 71 and thus by applying manual pressure to the two parts to swing them relative to one another to overcome the stop position, the parts can be swung to the next stop position and so on. When the required position is reached the bolt and nut 71 can be tightened Thus, the door 1 swings about the central longitudinal axis of pivot pin 11 which again is within the edge 5 of the door 1.

Parts 61 and 63 are made from an engineering quality strength plastics material such as a glass filled nylon. Other materials such as metals may be utilised if desired. It is felt, however, that the use of plastics material permits for ease of manufacture and results in economies relative to metal products.

In the second example, if offers similar advantages as the first example.

Modifications may be made to the present invention as would be apparent to persons skilled in the door arts and/or plastic moulding arts for example instead of using only two hinges, three, or more could be provided along the side edge 5 of the panel door 1.

These and other modifications may be made without departing from the ambit of the invention the nature of which is to be determined from the foregoing description.

We claim:

1. A hinge for a door, said hinge having a first arm for fitting to said door and a second arm for fitting to a structural support surface for said door, there being hinge pin means interconnecting said first arm and said second arm to permit relative hinging movement of said first arm and second arm, said first arm having a circular door mounting part for fitting into a corresponding circular cut-out provided through said door and overlapping a side edge of said door and not overlapping a top or bottom edge of said door, said first arm also having a door first face clamping part for abutting with one face of said door immediately surrounding said cut-out into which said door mounting part is fitted, said door first face clamping part being connected integrally with said circular door mounting part, said first arm also having a door second face clamping part for abutting with the opposite face of said door immediately surrounding said cut-out into which said door mounting part is passed, said first arm having screw means for engaging with both clamping parts to draw both clamping parts together, to clamp the hinge to said door at said cut-out, said hinge pin being, in use, thereby held at a side edge of said door at a position spaced from a top or bottom edge of said door.

2. A hinge as claimed in claim 1 including a respective cover plate for fitting over each door face clamping part.

3. A hinge as claimed in claim 1 wherein said circular door mounting part is half circular in shape for fitting to a half circular cut-out in said door.

4. A hinge as claimed in claim 1 wherein the central longitudinal axis of said hinge pin is positioned within said circular door mounting part so that when said hinge is mounted to said door the hinge axis will be inwardly of said edge of said door.

5. A hinge as claimed in claim 1 wherein said first arm is of a glass filled plastics material.

6. A hinge as claimed in claim 5 wherein said door first face clamping part and said door second face clamping part are of ribbed construction to provide resistance to bending or warping thereof.

7. A hinge as claimed in claim 1 wherein said hinge is for suspending said door from a jamb member or surface and said second arm comprises a jamb mount bracket.

8. A hinge as claimed in claim 1, wherein said hinge is for suspending said door from a glass panel and said second arm has a circular door mounting part for fitting into the thickness of said glass panel in a corresponding circular cut-out provided through said panel and overlapping a side edge of said panel, said second arm also having a glass panel first face clamping part for abutting with one face of said glass panel immediately surrounding said cut-out through said panel, and said second arm also having a door second face clamping part for abutting with the opposite face of glass panel immediately surrounding said cut-out into which said circular door mounting part is fitted, said second arm having screw means for engaging with both clamping parts to draw both clamping parts together, to clamp the hinge to said glass panel at said cut-out.

9. A hinge as claimed in claim 1 wherein said hinge has biasing means for biasing said hinge to return to a predetermined angular position after said hinge has been operated.

10. A hinge for a door, said hinge having a first arm for fitting to said door and a second arm for fitting to a structural support surface for said door, there being hinge pin means interconnecting said first arm and said second arm to permit relative hinging movement of said first arm and said second arm, said first arm having a circular door mounting part for fitting into a corresponding circular cut-out provided through said door and overlapping a side edge of said door, said first arm also having a door first face clamping part for abutting with one face of said door immediately surrounding said cut-out into which said door mounting part is fitted, said door first face clamping part being connected integrally with said door mounting part, said first arm also having a door second face clamping part for abutting with the opposite face of said door immediately surrounding said cut-out into which said door mounting part is passed, said first arm having holding means for holding both said door first face clamping part and said door second face clamping part to said door at said cut-out.

11. A hinge as claimed in claim 10 including a respective cover plate for fitting over each door face clamping part.

12. A hinge as claimed in claim 10 wherein a central longitudinal axis of said hinge pin means is positioned within said door mounting part so that when said hinge is mounted to said door the hinge axis will be inwardly of said edge of said door.

13. A hinge as claimed in claim 10 wherein said first arm is glass filled plastics material.

14. A hinge as claimed in claim 10 wherein said door first face clamping part and said door second face clamping part are of ribbed construction to provide resistance to bending or warping thereof.

15. A hinge as claimed in claim 10 wherein said hinge has biasing means to return the hinge to a predetermined angular position after said hinge has been operated.

16. A hinge as claimed in claim 15 wherein said biasing means comprise said hinge pin means having a flat face for co-operating with a detent means also with a co-operating flat face, and further biasing means urging said detent means into engagement with said hinge pin means whereby when both faces are angularly displaced relative to one another, said further biasing means will act to displace both faces into mating face-to-face relationship, thereby returning the hinge to said predetermined angular position.

17. A hinge as claimed in claim 15 wherein said second arm has a first part and a second part, and wherein said hinge pin means for swingably connecting said first arm to said second arm, connects with said second arm by connecting with said first part, said first part in turn being swingably connected with said second part, wherein said second part is for structurally supporting, said first part and said second part being holdable in a desired angular swing orientation to each other by holding means, whereby to align said door in said predetermined angular position set by the held swung orientation of said first arm and said second arm.

* * * * *